US009837766B1

(12) United States Patent
Cheng

(10) Patent No.: US 9,837,766 B1
(45) Date of Patent: Dec. 5, 2017

(54) USB WIRELESS DONGLE

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventor: Ren-Tsung Cheng, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/211,204

(22) Filed: Jul. 15, 2016

(30) Foreign Application Priority Data

May 25, 2016 (TW) ..... 105116336 A

(51) Int. Cl.

| | |
|---|---|
| ***H01R 13/635*** | (2006.01) |
| ***H01R 24/62*** | (2011.01) |
| ***H01R 13/66*** | (2006.01) |
| ***H01R 31/06*** | (2006.01) |
| *H01R 107/00* | (2006.01) |

(52) U.S. Cl.
CPC ..... *H01R 13/635* (2013.01); *H01R 13/665* (2013.01); *H01R 24/62* (2013.01); *H01R 31/06* (2013.01); *H01R 2107/00* (2013.01)

(58) Field of Classification Search
CPC ..... H01R 31/06; H01R 33/88; H01R 33/94; H01R 25/00; H01R 13/645; H01R 13/6453; H01R 29/00
USPC ..... 439/172–177, 518, 638
See application file for complete search history.

(56) References Cited

U.S. PATENT DOCUMENTS

| | | | | |
|---|---|---|---|---|
| 5,634,806 | A * | 6/1997 | Hahn | H01R 27/00 439/172 |
| 5,684,689 | A * | 11/1997 | Hahn | H01R 13/6675 363/146 |
| 7,204,723 | B2 * | 4/2007 | Sun | H01R 13/514 439/701 |
| 9,219,340 | B2 * | 12/2015 | McSweyn | H01R 27/00 |
| 9,362,673 | B1 * | 6/2016 | Rinker | H01R 13/6275 |

(Continued)

FOREIGN PATENT DOCUMENTS

| | | |
|---|---|---|
| CN | 203166239 U | 8/2013 |
| TW | M250202 | 11/2004 |
| TW | 201245925 A1 | 11/2012 |

*Primary Examiner* — Tulsidas C Patel
*Assistant Examiner* — Marcus Harcum
(74) *Attorney, Agent, or Firm* — ScienBizIP, P.C.

(57) ABSTRACT

A USB wireless dongle includes a main body and an adaptor, the adaptor includes a first mounting enclosure and a first USB plug. The first mounting enclosure defines a receiving cavity for a circuit board. An end of the first mounting enclosure adjacent to the first USB plug defines a through hole. The first USB plug includes a button and a contacting board. The contacting board is electrically connected to the circuit board. An elastic piece abuts the button, the button being fitted in the through hole. The button can be pressed to deform the elastic piece to enable the button to separate from the through hole and thereby the first USB plug can be disassembled from the first mounting enclosure to be replaced with another USB plug.

20 Claims, 7 Drawing Sheets

(56) References Cited

U.S. PATENT DOCUMENTS

2014/0335709 A1* 11/2014 Chung ..... H01R 31/06
439/172
2015/0031223 A1* 1/2015 Liao ..... H01R 13/44
439/136

* cited by examiner

USB WIRELESS DONGLE

CROSS-REFERENCE TO RELATED APPLICATIONS

This application claims priority to Taiwan Patent Application No. 105116336, filed on May 25, 2016, the contents of which are incorporated by reference herein.

FIELD

The subject matter herein generally relates to a USB wireless dongle.

BACKGROUND

Many computer users require wireless internet connectivity in an economical and readily accessible form. Accordingly, a computer may be fitted with a USB wireless dongle to enable the computer to wirelessly access the internet. However, the USB wireless dongle can be susceptible to being easily damaged because it is often repeatedly plugged into and out from the computer. Therefore, there is room for improvement within the art.

BRIEF DESCRIPTION OF THE DRAWINGS

Implementations of the present technology will now be described, by way of example only, with reference to the attached figures.

DETAILED DESCRIPTION

Figure 1:
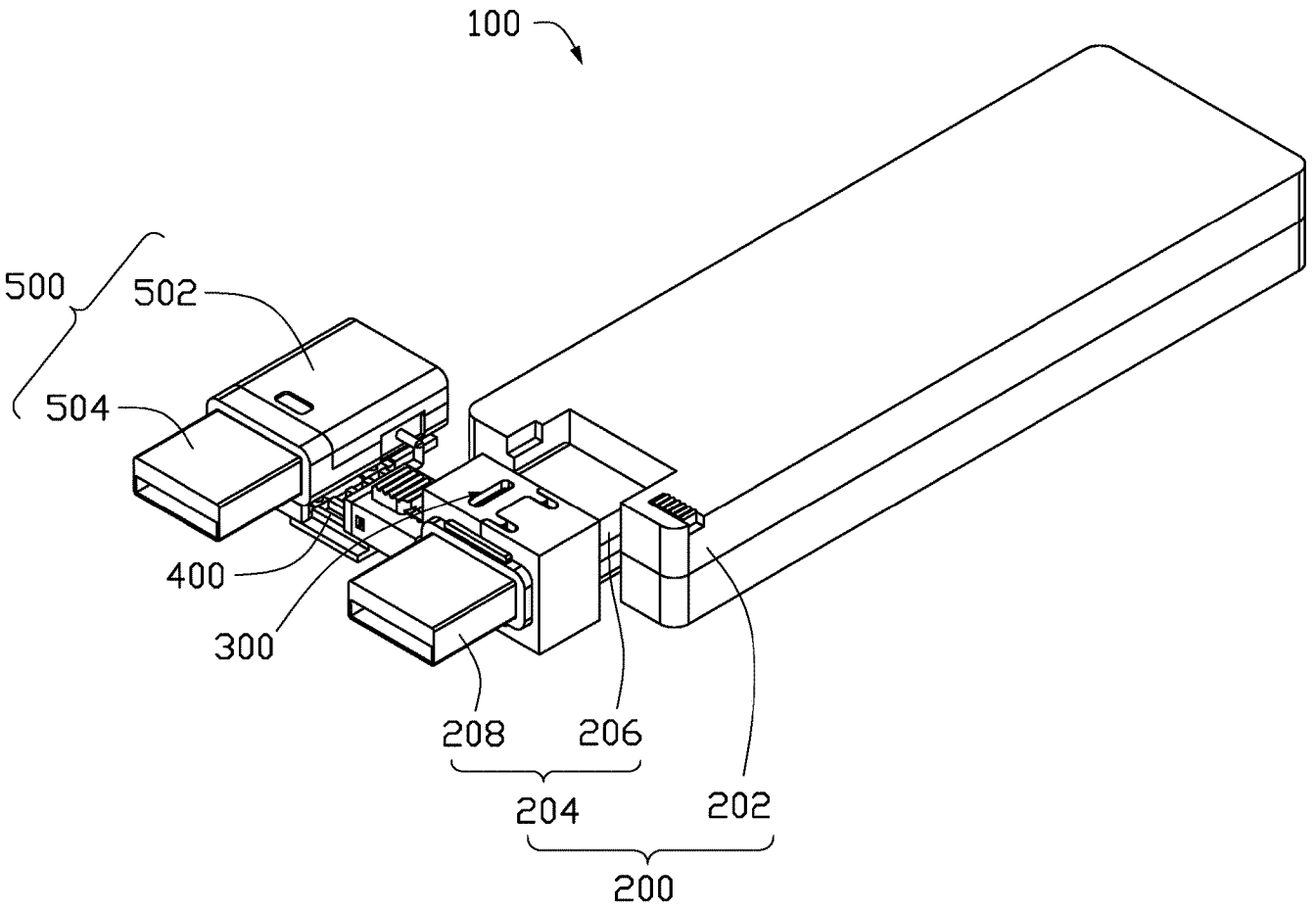
FIG. 1 is an isometric view of a USB wireless dongle.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series, and the like.

Figure 2:
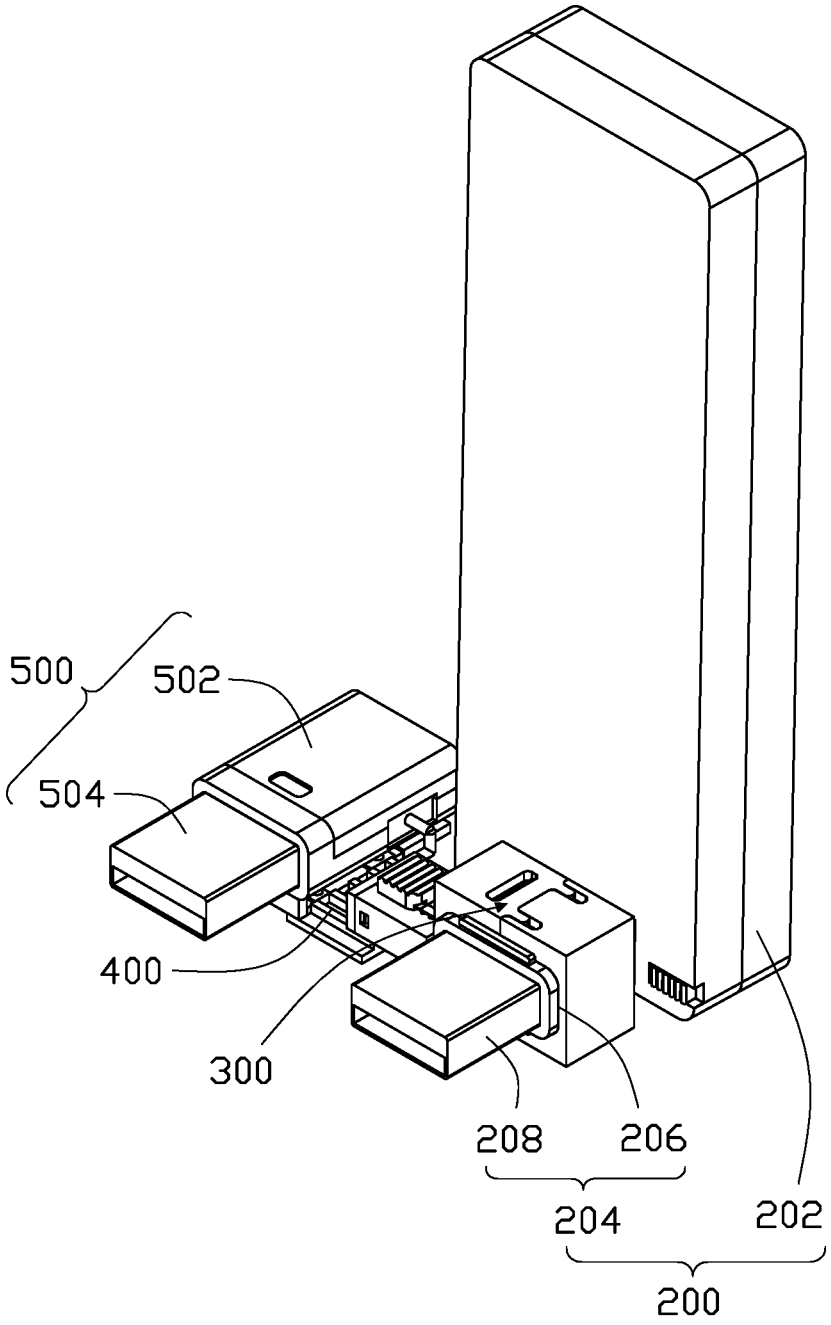
FIG. 2 is an alternative isometric view of the USB wireless dongle.

FIGS. 1 and 2 illustrate a USB wireless dongle 100. The USB wireless dongle 100 includes a dongle 200, a first connecting member 300, a second connecting member 400, and a storage device 500. The dongle 200 includes a main body 202 and an adaptor 204. The adapter 204 includes a first mounting enclosure 206 and a first USB plug 208. The first mounting enclosure 206 is mounted to the main body 202. The first USB plug 208 is mounted to the first mounting enclosure 206. The first USB plug 208 plugs into a USB port of an electronic device to enable the electronic device to wirelessly access the internet the dongle 200. The storage device 500 includes a second mounting enclosure 502 and a second USB plug 504 mounted to the second mounting enclosure 502.

The first connecting member 300 is detachably mounted to the first mounting enclosure 206. The second connecting member 400 is detachably mounted to the second mounting enclosure 502 and is mounted to the first connecting member 300. The storage device 500 and the adaptor 204 are positioned adjacent to another. When the first USB plug 208 plugs into one USB port of an electronic device, the storage device 500 can plug into an adjacent USB port of the electronic device to transmit data between the storage device 500 and the electronic device. The storage device 500 may be a USB flash disk. The first connecting member 300 is slidably attached to the second connecting member 400 to adjust a distance between the first connecting member 300 and the second connecting member 400.

Figure 3:
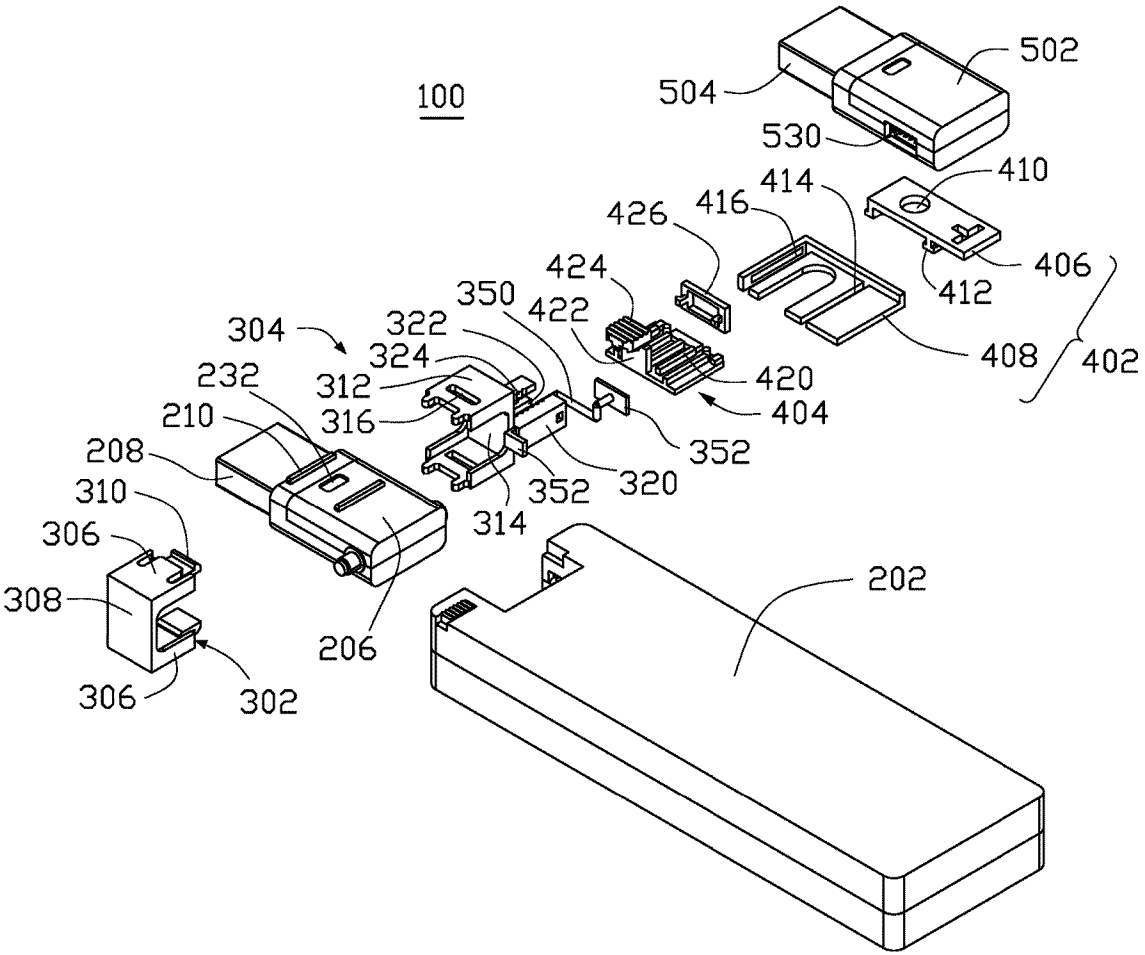
FIG. 3 is an exploded view of the USB wireless dongle shown in FIG. 1.
Figure 4:
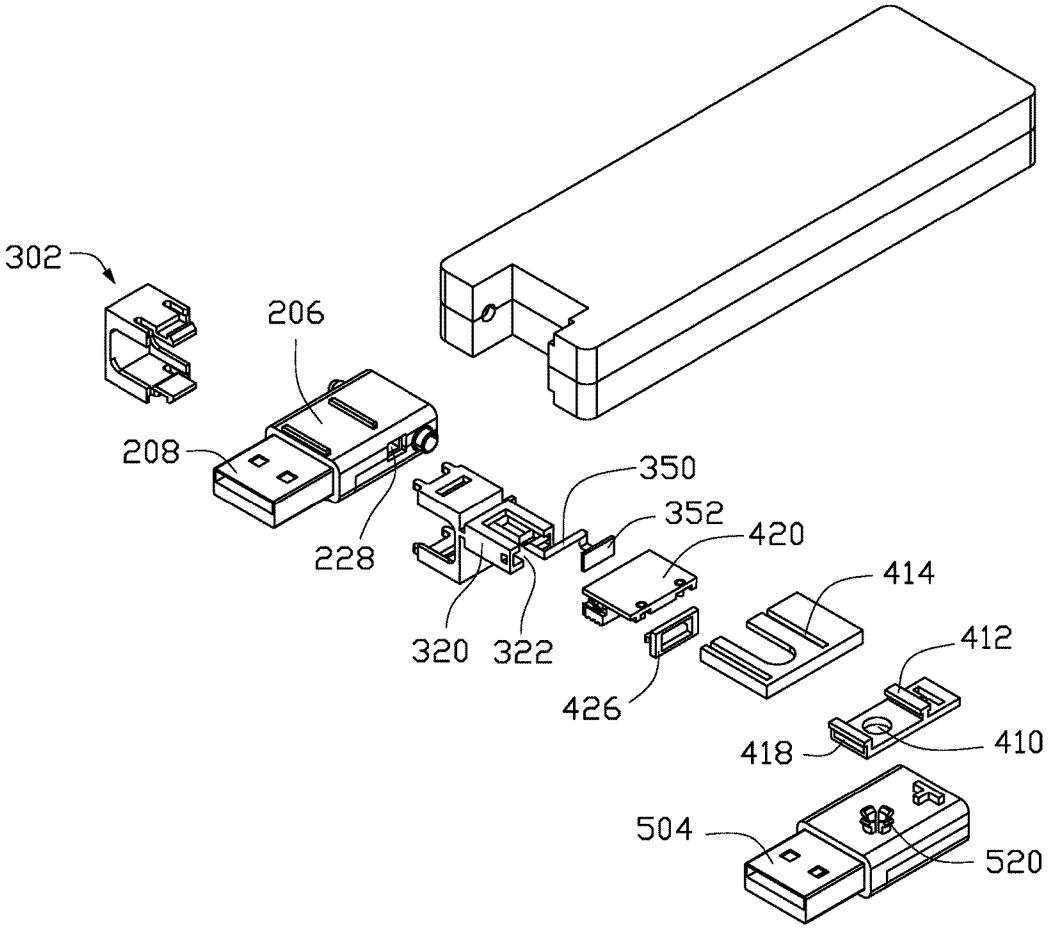
FIG. 4 is an alternative view of the USB wireless dongle shown in FIG. 1.

FIGS. 3 and 4 illustrate that the first connecting member 300 includes a first fastening member 302 and a locking member 304 mounted to the first fastening member 302. The first fastening member 302 includes two fastening pieces 306 and a connecting piece 308. The two fastening pieces 306 are parallel to each other. The connecting piece 308 is perpendicularly connected between a same side end of the two fastening pieces 306. A hook 310 extends from the other end of each of the two fastening pieces 306. The two hooks 310 are perpendicular to their fastening pieces 306 and are opposite to each other. The locking member 304 includes two locking pieces 312 and a clamping piece 314. The two locking pieces 312 are parallel to each other. The clamping piece 314 is perpendicularly connected between a same side end of the two locking pieces 312. Each locking piece 312 defines a locking hole 316. The two hooks 310 hook in the two locking holes 316 to form a receiving space (not labeled). The first mounting enclosure 206 is received in the receiving space and is mounted between the connecting piece 308 and the clamping piece 314 to fix the first mounting enclosure 206 to the first connecting member 300. Two restriction rods 210 protrude from a side of the first mounting enclosure 206. The two restriction rods 210 are perpendicular to a plug-in direction of the first USB plug. Each of the one fastening piece 306 and the one locking member 312 are mounted to the locking member 306 and abut against their respective two restriction rods 210.

The locking member 304 further includes a restriction piece 320. The restriction piece 320 perpendicularly extends from a side of the clamping piece 314 away from the locking hole 316. The restriction piece 320 defines a sliding groove 322 and a number of pairs of locking grooves 324 positioned at the sides of the sliding groove 322. The sliding groove 322 is positioned between the first mounting enclosure 206 and the second mounting enclosure 502. The sliding groove 322 extends to an end of the restriction piece 320 away from the clamping piece 314.

The second connecting member 400 includes a second fastening member 402 and a sliding member 404. The second fastening member 402 is mounted to the second mounting enclosure 502. The second fastening member 402 includes a fastening plate 406 and a sliding plate 408 slidably attached to the fastening plate 406. The second mounting enclosure 502 includes a locking portion 520 protruding therefrom. The fastening plate 406 defines a hole 410. The locking portion 520 fits in the hole 410 to fix the fastening plate 406 to the second mounting enclosure 502. The fastening plate 406 includes a T-shaped fastening rod 412. The T-shaped fastening rod 412 is perpendicular to a plug-in direction of the second USB plug 504. The sliding plate 408 defines sliding notch 414. The fastening rod 412 is slidably received in the sliding notch 414. The sliding plate 408 includes a first magnetic piece 416. The fastening plate 406 includes a second magnetic piece 418. The first magnetic piece 416 and the second magnetic piece 418 are both parallel to the sliding notch 414. The first magnetic piece 416 faces and contacts the second magnetic piece 418 to hold the fastening rod 412 in a sliding plane.

The sliding member 404 includes a mounting plate 420, a sliding portion 422 perpendicularly mounted to the mounting plate 420 and a blocking portion 424 perpendicularly mounted to an end of the sliding portion 422 away from the mounting plate 420. The mounting plate 420 is mounted to the sliding plate 408. When the sliding plate 408 slides along the direction of the sliding notch 414, the sliding member 404 also slides, to adjust a distance between the storage device 500 and the dongle 200. The sliding portion 422 is received in the sliding groove 322. The sliding portion 422 includes two elastic portions (not labeled). The two elastic portions are opposite to each other and are received in a pair of the locking grooves 324. Under an external force, the two elastic portions can slide from the pair of the locking grooves 324 to another pair of the locking grooves 324, to adjust the distance between the storage device 500 and the dongle 200. The blocking portion 424 is positioned above the sliding groove 322 to prevent the sliding portion 422 sliding out of the sliding groove 322 along a direction perpendicular to the sliding groove 322. The first connecting member 300 further includes a stopping member 426. The stopping member 426 is mounted to an end of the restriction piece 320 away from the clamping piece 314 to prevent the sliding portion 422 sliding out of the sliding groove 322 along the sliding groove 322.

Figure 5:
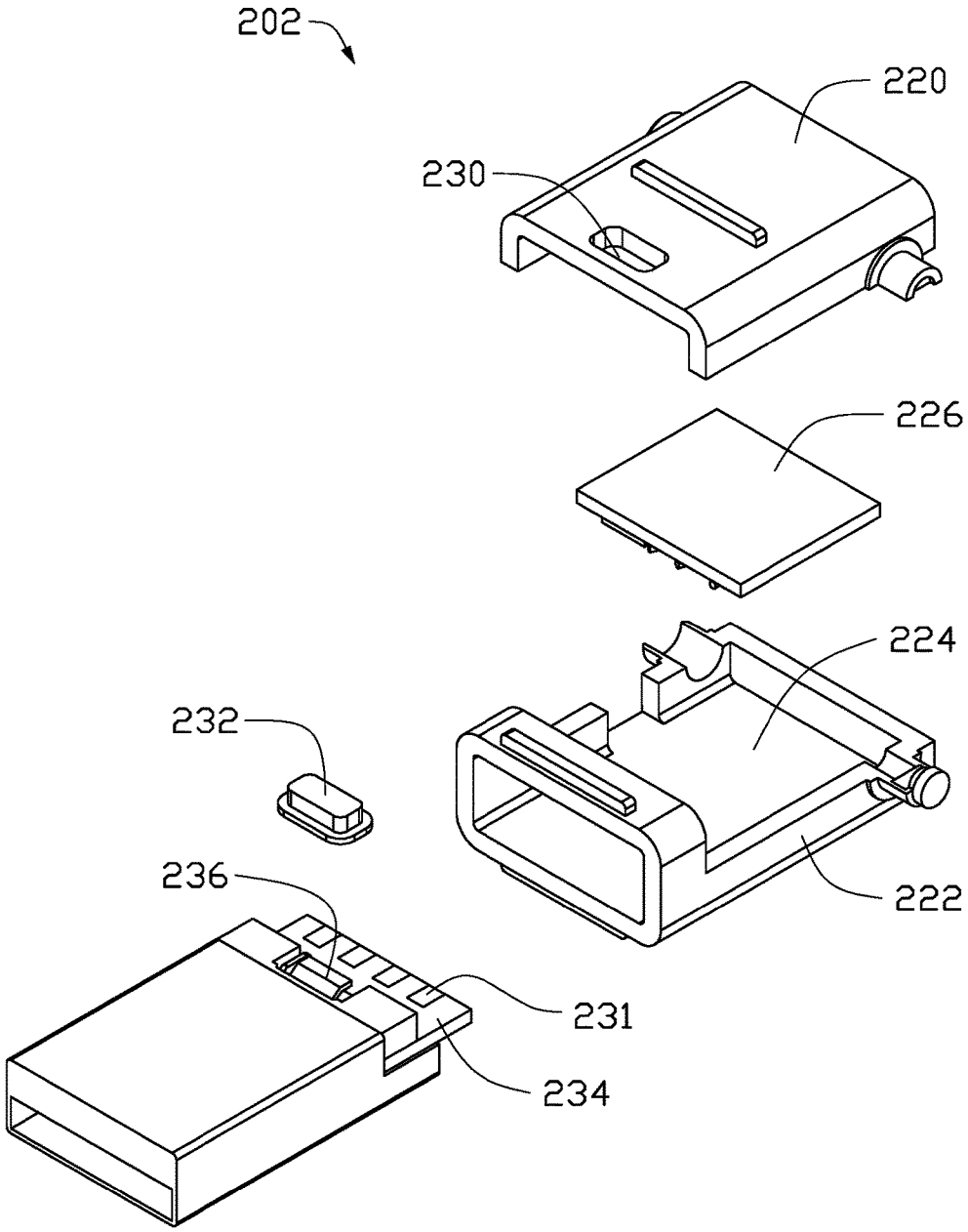
FIG. 5 is an exploded view of an adaptor of the USB wireless dongle shown in FIG. 1.
Figure 6:
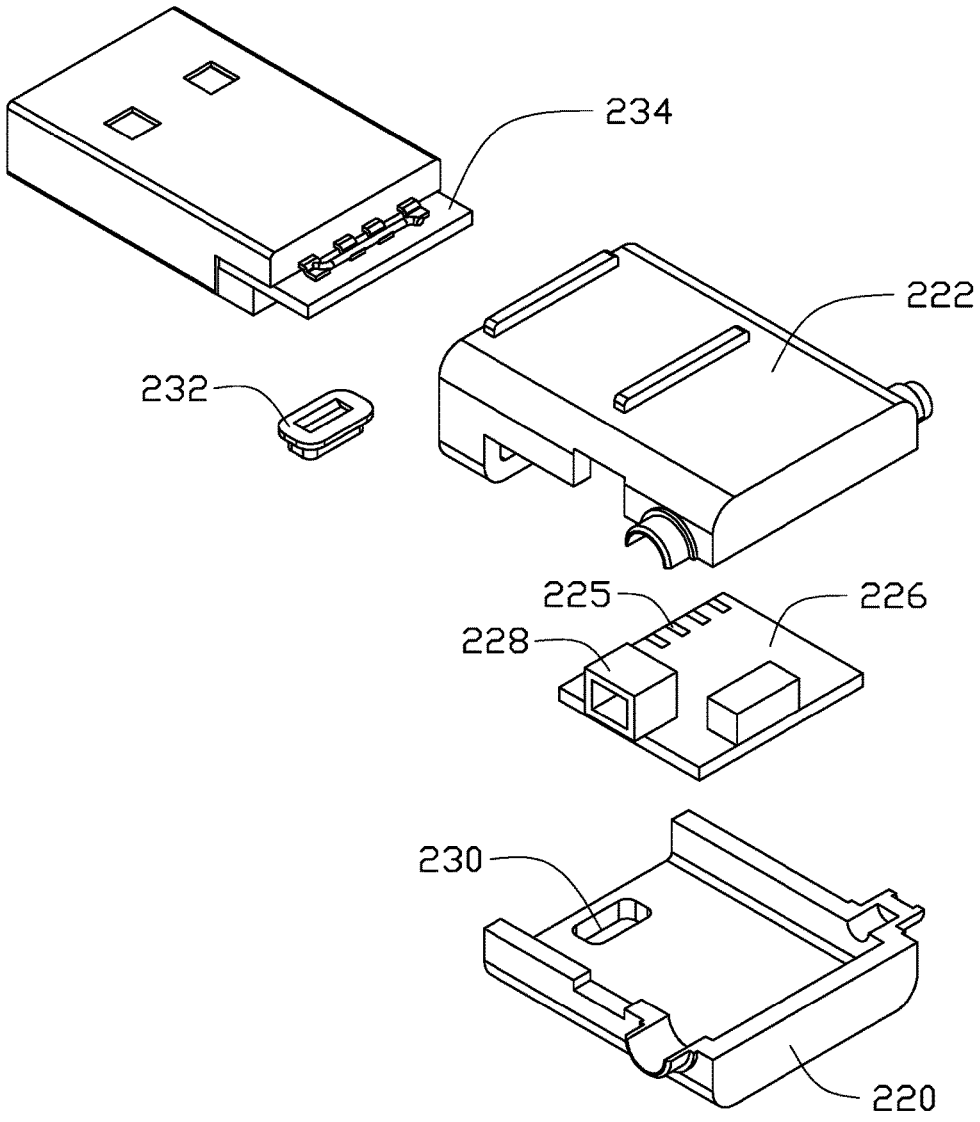
FIG. 6 is an alternative view of the adaptor of the USB wireless dongle shown in FIG. 5.
Figure 7:
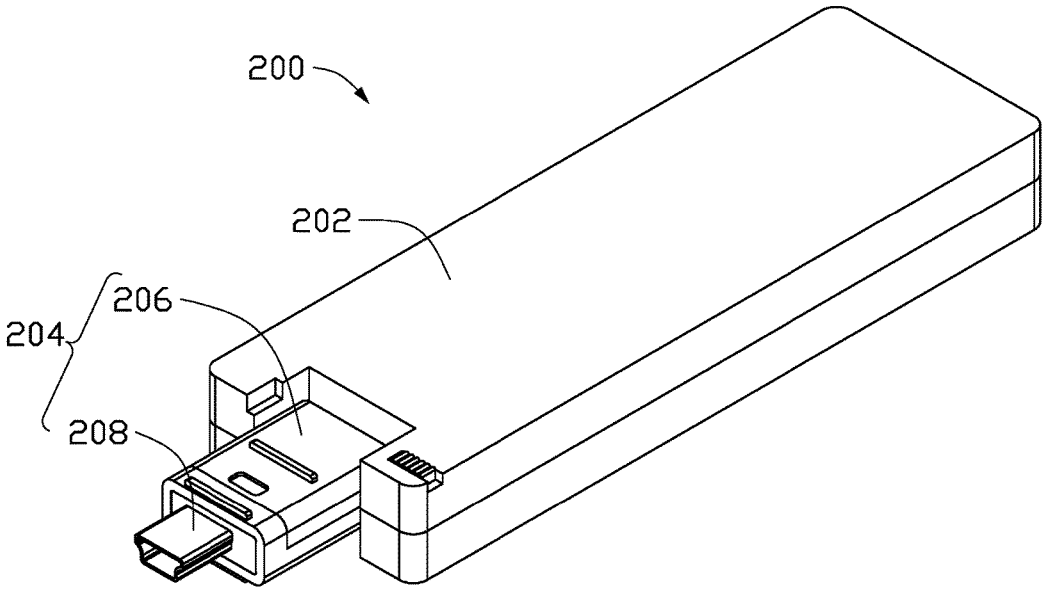
FIG. 7 is an isometric view of another adaptor of the USB wireless dongle shown in FIG. 1.

FIGS. 5 and 6 illustrate that the first mounting enclosure 206 includes a top enclosure 220 and bottom enclosure 222. The top enclosure 220 faces and is attached to the bottom enclosure 222 to form a receiving cavity 224. A circuit board 226 is received in the receiving cavity 224. The circuit board 226 includes a number of pins 225 and a first connector 228. The first connector 228 is received in the first mounting enclosure 206 and is visible from the outside of the first mounting enclosure 206. An end of the top enclosure 220 adjacent to the first USB plug 208 defines a through hole 230. The first USB plug 208 includes a button 232 and a contacting board 234. The contacting board 234 includes a number of pins 231. The pins 231 on the contacting board 234 correspond to the pins 225 on the circuit board 226. The pins 231 on the contacting board 234 connect to the pins 225 on the circuit board 226 to enable the contacting board 234 to electrically connect the circuit board 226. An elastic piece 236 abuts against the button 232. The button 232 fits in the through hole 230. The button 232 can be pressed to enable the elastic piece 236 to be deformed and to separate from the through hole 230. Thus, the first USB plug 208 is detachable from the first mounting enclosure 206. Then, the first USB plug 208 can be replaced with another USB plug. FIG. 7 illustrates that the first USB plug 208 can be an A-type USB plug. The other USB plug can be a mini USB plug. A mounting mode of the second mounting enclosure 502 when mounting to the second USB plug 504 is similar to the mounting manner of the first mounting enclosure 206 when mounting to the first USB plug 208. The second USB plug 504 is also detachable from the second mounting enclosure 502. The second USB plug 504 can be replaced with another USB plug.

FIGS. 3 and 4 further illustrate that the storage device 500 includes a second connector 530. The second connector 530 is mounted in the second mounting enclosure 502 and is visible from the outside of the second mounting enclosure 502. A cable 350 is mounted to the locking member 304. Connecting plugs 352 are mounted to ends of cable 350. The two connecting plugs 352 connect to the first connector 228 and the second connector 530 to enable the storage device 500 to electrically connect to the dongle 200.

The embodiments shown and described above are only examples. Even though numerous descriptions and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims.

What is claimed is:

1. A USB wireless dongle comprising:

a main body;

an adaptor comprising:

a first mounting enclosure defining a receiving cavity, an end of the first mounting enclosure adjacent to the main body defining a through hole;

a circuit board received in the receiving cavity and comprising a plurality of pins; and a first USB plug mounted to the first mounting enclosure, the first USB plug comprising:

a button;

a contacting board comprising a plurality of pins corresponding to the pins on the circuit board, the pins on the contacting board connecting to the pins on the circuit board; and an elastic piece abutting against the button;

wherein the button fits in the through hole, wherein the button is pressed to enable the elastic piece to be deformed to separate from the through hole to detach the first USB plug from the first mounting enclosure for replacing the first USB plug with another USB plug.

2. The USB wireless dongle as claimed in claim 1, wherein the first mounting enclosure comprises a top enclosure and bottom enclosure, the top enclosure faces and is attached to the bottom enclosure to form the receiving cavity, the top enclosure defines the through hole.

3. The USB wireless dongle as claimed in claim 1, further comprising:

a first connecting member detachably mounted to the first mounting enclosure;

a storage device comprising a second mounting enclosure and a second USB plug mounted to the second mounting enclosure, the storage device and the adaptor being positioned adjacent to another; and a second connecting member detachably mounted to the second mounting enclosure and mounted to the first connecting member to connect the storage device to the adaptor;

wherein the storage device and the adaptor are configured to plug two adjacent USB ports of an electronic device.

4. The USB wireless dongle as claimed in claim 3, wherein the first connecting member is slidably attached to the second connecting member to adjust a distance between the first connecting member and the second connecting member.

5. The USB wireless dongle as claimed in claim 4, wherein the first connecting member defines a sliding groove and a plurality of pairs of locking grooves positioned at two sides of the sliding groove, the sliding groove is positioned between the first mounting enclosure and the second mounting enclosure, the second connecting member comprises two elastic portions, the elastic portions lock in a pair of locking grooves and is slidable from the pair of locking grooves to another pair of locking grooves.

6. The USB wireless dongle as claimed in claim 3, wherein the first connecting member comprises a first fastening member and a locking member, the locking member faces and is mounted to the first fastening member, the first fastening member and the locking member together form a receiving space, the first mounting enclosure is received in the receiving space.

7. The USB wireless dongle as claimed in claim 6, wherein the first fastening member comprises two parallel fastening pieces and a connecting piece connecting the two fastening pieces, the two fastening pieces extend two hooks thereon, the locking member comprises two parallel locking pieces and a clamping piece connecting the two locking pieces, each locking piece defines a locking hole, two hooks lock in the two locking holes, the first mounting enclosure is mounted between the connecting piece and the clamping piece.

8. The USB wireless dongle as claimed in claim 3, wherein the second connecting member comprises a second fastening member, the second fastening member comprises a fastening plate and a sliding plate, the fastening plate is mounted to the second mounting enclosure, the sliding plate is slidably attached to the fastening plate.

9. The USB wireless dongle as claimed in claim 8, wherein the fastening plate comprises a T-shaped fastening rod, the T-shaped fastening rod is perpendicular to a plug direction of the second USB plug, the sliding plate defines a sliding notch, the fastening rod is slidably received in the sliding notch.

10. The USB wireless dongle as claimed in claim 9, wherein the sliding plate comprises a first magnetic piece, the fastening plate comprises a second magnetic piece, the first magnetic piece and the second magnetic piece are both parallel to the sliding notch, the first magnetic piece faces and contacts the second magnetic piece.

11. A USB wireless dongle comprising:

a main body;

an adaptor comprising:

a first mounting enclosure defining a receiving cavity, an end of the first mounting enclosure adjacent to the main body defining a through hole;

a first circuit board received in the receiving cavity; and a first USB plug mounted to the first mounting enclosure, the first USB plug comprising:

a button;

a second circuit board electrically connected to the first circuit board; and an elastic piece positioned below the button;

wherein the button fits in the through hole, wherein the button is pressed to enable the elastic piece to be deformed to separate from the through hole to detach the first USB plug from the first mounting enclosure for replacing the first USB plug with another USB plug.

12. The USB wireless dongle as claimed in claim 11, wherein the first mounting enclosure comprises a top enclosure and bottom enclosure, the top enclosure faces and is attached to the bottom enclosure to form the receiving cavity, the top enclosure defines the through hole.

13. The USB wireless dongle as claimed in claim 11, further comprising:

a first connecting member detachably mounted to the first mounting enclosure;

a storage device comprising a second mounting enclosure and a second USB plug mounted to the second mounting enclosure, the storage device and the adaptor being positioned adjacent to another, the storage device and the adaptor configured to plug two adjacent USB ports of an electronic device; and a second connecting member detachable mounted to the second mounting enclosure and mounted to the first connecting member to connect the storage device to the adaptor.

14. The USB wireless dongle as claimed in claim 13, wherein the first connecting member is slidably attached to the second connecting member to adjust a distance between the first connecting member and the second connecting member.

15. The USB wireless dongle as claimed in claim 14, wherein the first connecting member defines a sliding groove and a plurality of pairs of locking grooves positioned at two sides of the sliding groove, the sliding groove is positioned between the first mounting enclosure and the second mounting enclosure, the second connecting member comprises two elastic portions, the elastic portions lock in a pair of locking grooves and is slidable from the pair of locking grooves to another pair of locking grooves.

16. The USB wireless dongle as claimed in claim 13, wherein the first connecting member comprises a first fastening member and a locking member, the locking member faces and is mounted to the first fastening member, the first fastening member and the locking member together form a receiving space, the first mounting enclosure is received in the receiving space.

17. The USB wireless dongle as claimed in claim 16, wherein the first fastening member comprises two parallel fastening pieces and a connecting piece connecting the two fastening pieces, the two fastening pieces extend two hooks thereon, the locking member comprises two parallel locking pieces and a clamping piece connecting the two locking pieces, each locking piece defines a locking hole, two hooks lock in the two locking holes, the first mounting enclosure is mounted between the connecting piece and the clamping piece.

18. The USB wireless dongle as claimed in claim 13, wherein the second connecting member comprises a second fastening member, the second fastening member comprises a fastening plate and a sliding plate, the fastening plate is mounted to the second mounting enclosure, the sliding plate is slidably attached to the fastening plate.

19. The USB wireless dongle as claimed in claim 18, wherein the fastening plate comprises a T-shaped fastening rod, the T-shaped fastening rod is perpendicular to a plug direction of the second USB plug, the sliding plate defines a sliding notch, the fastening rod is slidably received in the sliding notch.

20. The USB wireless dongle as claimed in claim 19, wherein the sliding plate comprises a first magnetic piece, the fastening plate comprises a second magnetic piece, the first magnetic piece and the second magnetic piece are both parallel to the sliding notch, the first magnetic piece faces and contacts the second magnetic piece.

* * * * *